United States Patent [19]

Lewis

[11] 4,067,739

[45] Jan. 10, 1978

[54] METHOD OF PREPARING A MONOSIZE SILVER HALIDE EMULSION INVOLVING OSTWALD RIPENING FOLLOWED BY A CRYSTAL GROWTH STAGE

[75] Inventor: John Derek Lewis, Brentwood, England

[73] Assignee: Ciba-Geigy AG, Basel, Switzerland

[21] Appl. No.: 601,965

[22] Filed: Aug. 4, 1975

[30] Foreign Application Priority Data

Aug. 7, 1974 United Kingdom ..... 34769/74

[51] Int. Cl.[2] ..... G03C 1/02

[52] U.S. Cl. ..... 96/94 R; 96/114.7

[58] Field of Search ..... 96/94 R, 114.7; 252/5

[56] References Cited

U.S. PATENT DOCUMENTS

| | | | |
|---|---|---|---|
| 3,650,757 | 3/1972 | Irie et al. | 96/114.7 |
| 3,655,394 | 4/1972 | Illingworth | 96/94 R |
| 3,736,144 | 5/1973 | Nagae et al. | 96/94 R |
| 3,773,516 | 11/1973 | Gutoff | 96/94 R |
| 3,790,387 | 2/1974 | Musliner | 96/114.7 |
| 3,817,756 | 6/1974 | Claes et al. | 96/94 R |
| 3,885,970 | 5/1975 | Miyahara | 96/94 R |

FOREIGN PATENT DOCUMENTS

| | | | |
|---|---|---|---|
| 2,078,586 | 10/1971 | France | 96/94 R |
| 1,335,925 | 10/1973 | United Kingdom | 96/94 R |

*Primary Examiner*—David Klein
*Assistant Examiner*—Louis Falasco
*Attorney, Agent, or Firm*—Burgess, Dinklage & Sprung

[57] ABSTRACT

A method of preparing a monosize silver halide emulsion of which most of the silver halide crystals are of the twinned octahedral type is provided. An aqueous solution of a silver salt and an aqueous solution of an alkali metal or ammonium halide in an aqueous dispersing medium containing a protective colloid are mixed at such concentration that the silver halide is nucleated, causing the silver halide nuclei to increase in size in the presence of a silver halide solvent by Ostwald ripening to produce a population of twinned octahedral seed crystals. Then the maximum rate of addition of silver salt and alkali metal or ammonium halide which is possible without renucleation occurring and the minimum rate of addition of silver salt and alkali metal or ammonium halide which is possible without Ostwald ripening occurring is determined and the seed crystals are caused to grow by adding to the aqueous dispersing medium aqueous silver salt solution and aqueous alkali metal or ammonium halide solution at a rate between the predetermined maximum and minimum rates and then at intervals the maximum and minimum addition rates are re-determined and the addition rates of silver and halide are adjusted to ensure that at all times during the crystal growth stage neither renucleation nor Ostwald ripening occurs, the p Br of the liquid phase being maintained above 0.15 during the whole crystal growth stage. The silver halide emulsions are useful for preparing photographic material.

9 Claims, 2 Drawing Figures

Figure 1:
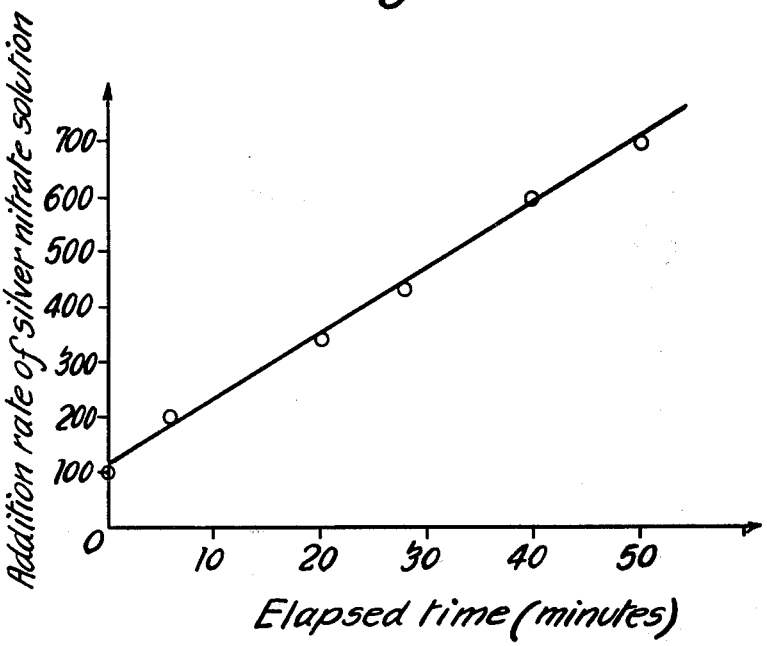

METHOD OF PREPARING A MONOSIZE SILVER HALIDE EMULSION INVOLVING OSTWALD RIPENING FOLLOWED BY A CRYSTAL GROWTH STAGE

This invention relates to the production of silver halide photographic emulsions and in particular to the controlled formation of suspensions of silver halide in a gelatin medium.

The method of preparation that has been longest known, and is still predominantly used, is to precipitate silver halide in a solution of gelatin, under controlled conditions of temperature and of concentrations of reactants, and to ripen the resulting silver halide suspension under the influence of weak solvents for the silver halide, normally alkali metal or ammonium halide optionally in the presence of ammonia, or other amines.

During the ripening process the average crystal size of the silver halide crystals increases, due to the dissolution of crystals that are more soluble than others and the deposition of the silver halide from them on the less soluble crystals. The crystals may possess a range of solubilities due to their size differences (smaller crystals being more soluble than large crystals) or due to differences in composition. For example, the influence of silver iodide is to reduce the solubility of silver bromide with which it is admixed.

The ripening process to produce crystal growth is an essential part of emulsion production because the maximum sensitivity that an emulsion crystal can be given (by subsequent sensitisation processes) is related to the dimensions of the crystal, and the sensitivity of the emulsion as a whole is of course derived from the sensitivities of the crystals that comprise it.

It is also, however, an essential part of emulsion production to control, not only the average of median size of the crystals of an emulsion, but also the crystal size distribution. In general, a wide range of sizes leads to low contrast, and a narrow range of sizes leads to high contrast, the latter being desirable for many photographic applications, such as in the graphic arts and radiographic fields.

The process of ripening as described above leads naturally to crystals of varying size, but nevertheless by choice of conditions for silver halide precipitation and ripening, it is possible to control the mean crystal size and the crystal size distribution of emulsions.

Various methods are known which produce a narrow size-distribution of crystals for a photographic emulsion. One such is described in British patent specification No. 1,335,925.

One important feature of the preferred method described therein is that the addition of silver halide (as silver and halide ions) is performed at constant temperature and constant pAg. By pAg is meant the negative logarithm of the silver ion activity. In this preferred method the addition of fresh silver halide to silver halide nuclei is controlled at such a rate as to maintain a high degree of supersaturation in solution. One way of achieving this is to ensure that the addition rate of the silver halide is increased as a function of the mean linear size of the crystals.

The degree of supersaturation of the silver halide in the liquid phase of the dispersing medium may be defined as:

Concentration of silver halide in solution.

Concentration of silver halide in a saturated solution.

Thus the degree of supersaturation is a ratio. The present invention relates to the preparation of a narrow size distribution of crystals for a photographic emulsion, where the majority of the crystals have no sensible mean linear size which can be related to their growth characteristics. A particular case of such crystals are twinned octahedral crystals. Such crystals are of an octahedral shape, the octahedron being divided symmetrically by a plane parallel to one pair of (III) faces, there being one portion of the crystal which is rotated through 180° about the triad axis normal to the (III). A crystal of this type may contain one or more twinned planes. (A description of twinned crystals is given in "An Introduction to Crystallography" by F. C. Phillips, 3rd Edn. Longmans 1966, pages 162–165 and the "The Crystalline State" by P. Gay, Oliver and Boyd, 1972, pages 328–338.)

Thus in the case of twinned octahedral crystals the mean linear size has little bearing on the growth of these crystals as twinned crystals have a variety of shapes and thickness for a particular crystal diameter, and thus it is not possible to prepare twinned octahedral emulsions of narrow size distribution by the method of B.P. Ser. No. 1,335,925 because the twinned seed crystals used to produce the twinned octahedral crystals are such that various faces would have calculated growth rates different from those found in practice because the crystals were not formed under the same conditions as the further growth is to proceed. Further even if the crystals would have such calculated growth rates which accord with practice, the ab initio calculation of such growth rates would involve a prohibitive amount of work.

The method of producing emulsions containing silver halide crystals of regular habit, e.g. cubic or untwinned octahedral crystals, and wherein a narrow crystal size distribution is obtained by a constant addition of silver and halide, is not suitable for obtaining monosized twinned octahedral crystal containing emulsions because this method when used with twinned seed crystals tends to lead to Ostwald ripening which would cause a heterodisperse emulsion to be obtained. This is because the seed crystals employed in preparing the emulsions are frequently markedly heterodisperse. By this is meant that the coefficient of variation of the diameter of the circles of equivalent area to the highest area face of the crystals is greater than 20% and the conditions for growth are such that the equilibrium solubility of silver halide is markedly greater than it is in the preparation of regular crystals which have a meaningful mean linear size.

We have now discovered a method for preparing an emulsion wherein the silver halide crystals are monosized twinned octahederal crystals.

A method of preparing a monosize silver halide emulsion of which most of the silver halide crystals are of the twinned octahedral type which comprises a. mixing an aqueous solution of a silver salt and an aqueous solution of an alkali metal or ammonium halide in an aqueous dispersing medium containing a protective colloid at such a concentration that the silver halide is nucleated, b. causing the silver halide nuclei to increase in size in the presence of a silver halide solvent by Ostwald ripening to produce a population of twinned octahedral seed crystals, c. determining the maximum rate of addition of silver salt and alkali metal or ammonium halide which is possible without renucleation occurring and determining the minimum rate of addition of silver salt and alkali metal or ammonium halide which is possible without Ostwald ripening occurring, d. causing the seed crystals to grow by adding to the aqueous dispersing medium aqueous silver salt solution and aqueous alkali metal or ammonium halide solution at a rate between the predetermined maximum and minimum rates and then at intervals re-determining the maximum and minimum addition rates and adjusting the addition rates of silver and halides to ensure that at all times during the crystal growth stage neither renucleation nor Ostwald ripening occurs, the p Br of the liquid phase being maintained above 0.15 during the whole crystal growth stage.

p Br is defined as the negative logarithm of the bromide ion activity. p Br 0.15 corresponds to approximately 0.71 M bromide.

Preferably in the method of the present invention during crystal growth the p Br should be controlled between 1.00 and 3.00, preferably between 1.00 and 1.30 and the temperature of the liquid phase should be between 35° and 80° C, preferably between 45° to 55° C.

Most preferably the p Br of the liquid phase should be controlled at 1.15 and the temperature of the liquid phase should be 50° C.

There are many ways known to produce silver halide nuclei which, after Ostwald ripening will produce a population of twinned octahedral seed crystals. One of the simplest methods is to add rapidly a dilute solution of a soluble silver salt to a dilute solution of a gelatin and alkali metal or ammonium halide. The alkali metal or ammonium halide in the gelatin solution should be slightly greater in quantity than would be necessary to just react with all the silver salt added and this excess acts as a solvent for the Ostwald ripening stage. A method of producing a population of twinned octahedral seed crystals is described in the first formula in Glafkides, Photographic Chemistry Vol. 1, p. 328, Fountain Press, London 1958.

By Ostwald ripening is meant the growth of the less soluble nucleated crystals, in general the larger crystals, at the expense of the more soluble crystals, the smaller crystals, in the presence of a silver halide solvent.

During the growth of the seed crystal growth stage some unusually shaped silver halide crystals may be formed but these disintegrate within a short time and thus may be considered as unstable.

Preferably in the method of the present invention the formation of twinned seed crystals occurs in the second stage at a high pAg (above 11) and growth of the twinned octahedral crystals occurs at a low pAg (below 10.1) sufficient to prevent further twin formation and to form crystals with known external faces, most preferred (III) faces.

The method of the present invention is a three stage process. In the first stage the silver halide nuclei are formed, in the second stage Ostwald ripening takes place to produce the seed twinned octahedral silver halide crystals. In the third stage the seed silver halide crystlas are caused to grow in size to form a monosized twinned octahedral crystal population. However as hereinbefore stated fresh nuclei may be formed at the same time as the previously formed nuclei are undergoing Ostwald ripening. The change from the second to the third stage may be stepwise or continuous. However it is possible for the second stage to occur before the first stage has been completed. This is to say growth of the silver halide nuclei to form twinned seed crystals occurs whilst new nuclei are being formed.

In one preferred method according to the present invention the aqueous silver salt solution and the aqueous alkalimetal or ammonium halide solution are added at a continuously increasing rate which is approximately proportional to the time from the start of crystal growth after seed formation, the remainder of the conditions in the dispersing medium which affect the solubility of the silver halide in solution being maintained constant.

In this method of the invention the rate of addition of the fresh silver and halide may be a function of elapsed time $t$ according to the formula $bt + c$ where $b$ and $c$ are constant quantities.

However it is not possible to make emulsions of the twinned octahedral type by adding fresh silver halide as a function of elapsed time, $t$, according to the formula at $2 + bt + c$ since such an addition rate will lead eventually to the formation of fresh nuclei and thus to a heterodisperse emulsion. The method of the present invention does not rely on any specific growth law being obeyed. However, we have found that the maximum rate of addition to the crystals is most nearly approximated by the formula $bt + c$ where $b$ and $c$ are constant quantities and $t$ is the time. Except in the trivial case where $a$ is zero, the formula at $2 + bt + c$ represents a greater time-dependent addition rate than $bt + c$ and so would eventially lead to the addition rate exceeding the critical level for renucleation. This would lead to a heterodisperse emulsion.

To determine the maximum addition rate without renucleation occuring for any given crystal population, samples are taken and to each is added an equal quantity of silver halide (at the conditions chosen) at increasing rates. From observations on an optical or electron microscope it is seen that at above a certain silver halide addition rate renucleation, that is the formation of new crystals, just occurs, by this is meant that for every one thousand crystals observed ten renucleated crystals are observed. The renucleated crystals are distinguishable because they are much smaller than the seed crystals. This addition rate is the maximum addition rate which is possible without renucleation occuring.

In order to determine the minimum rate of addition possible without Ostwald ripening occuring, samples are taken of the crystal population and to each is added an equal quantity of silver halide at decreasing rates below the maximum addition rate determined above.

From observations on an optical or electron microscope it is seen that below a certain silver halide addition rate Ostwald ripening just occurs. Ostwald ripening has occured when twinned crystals smaller than the smallest twinned crystals observed when adding at the maximum addition rate are seen in the optical or electron microscope. These crystals are the result of dissolution of large crystals. The rate of addition below which Ostwald ripening is seen to occur is the minimum rate of addition possible without Ostwald ripening.

Having established the maximum and minimum addition rates for a given crystal population by the above experiments, a quantity of silver and halide ions are added to that population at constant pAg and temperature, keeping the addition rate between the maximum and the minimum.

As the crystals grow, the supersaturation level decreases, and it is necessary after a certain time, to determine a new maximum and minimum addition rate as described above. The amount of silver halide (added as silver and halide ions) to be added before re-determining the addition rates is determined by experience. Continued addition at too low an addition rate would lead to ripening and a notable widening of the size distribution of the crystals. It has been found desirable to redetermine the maximum and minimum addition rates after the addition of a equal amount of silver to that present at the last determination.

The preferred rate of addition of the silver salt and alkali metal or ammonium halide during crystal growth is ninety percent of the maximum rate of addition which is possible without renucleation occuring.

In another method according to the present invention the aqueous silver salt solution and the aqueous alkali-metal or ammonium halide solution are added in stepwise increased amounts, the rates of which are approximately proportional to the time from the start of crystal growth after seed formation, the remainder of the conditions in the dispersing medium which affect the solubility of the silver halide in solution being maintained constant.

Equipment for making such additions may, for example, consist of pumps capable of programmed variation of pumping rate, two pistons operated together by cams of calculated profile, pressure vessels operated by air or hydraulic pressure, variable flow valves, variable height liquid storage, or variable jet dimensions.

In the method of the present invention the requisite conditions in the dispersing medium may be controlled, by means other than by increasing the rate of addition of fresh silver halide. For example, the temperature of the dispersing medium may be controlled to reduce silver halide solubility in such a way that the degree of supersaturation remains substantially constant whilst the silver halide crystal size increases. Alternatively the crystal growth may take place in the presence of a silver halide solvent in the solution such as ammonia, which may be changed in concentration in such a manner as to maintain a high degree of supersaturation during growth.

Alternatively the pAg of the solution may be altered in order to maintain a high degree of supersaturation during growth.

In other methods the type of silver halide may be altered during the growth stage; also the type of silver halide solvent, if present, may be altered; or a combination of these effects may be used.

The monosized twinned octahedral emulsions as prepared by the process of the present invention are of particular use in radio-graphic film material, direct positives and graphic arts film material for which use their high contrast and covering power are particular advantageous. If required the monosized twinned octahedral emulsions can be used as blended emulsions containing different but selected crystal sizes thus enabling any desired contrast and covering power to be obtained. Such blended emulsions may be used in camera film material.

The invention thus includes monosized photographic silver halide emulsions prepared by the methods of the present invention as hereinbefore set forth as well as photographic material comprising in a layer thereof at least one such monosized photographic silver halide emulsion.

The following Examples will serve to illustrate the invention.

EXAMPLE 1

In the example the silver halide nuclei were prepared by mixing 1.0 mole of silver nitrate solution with 0.91 moles of ammomium bromide and 0.09 moles of potassium iodide in the presence of 11g of gelatin in 100ml of water. The nuclei were caused to increase in size by ripening in the presence of added ammonia and ammonium bromide to give a population of twinned octahedral seed crystals with a medium linear crystal size of 0.63 $\mu$ and having a coefficient of variation of 30%. This population was coagulated, washed and redispersed. The seed crystals were twinned to the extent of greater than 99%.

160g of the redispersed coagulum containing 0.167 moles of silver was mixed with 25g of gelatin and its pAg adjusted to 10.0 at a temperature of 50° C. The solution was stirred and 4.7M silver nitrate solution and an equivalent quantity of ammonium bromide solution added, under pAg controlled conditions in two trials to the population of twinned octahedral seed crystals; the rates used were 110 and 160 mls per hour. The trial with the addition rate of 160mls per hour clearly showed renucleation to have occurred; the trial with 110 mls per hour showed no renucleation. A further trial at 135 mls per hour again showed renucleation. The rate of 110 mls per hour was therefore chosen as the maximum rate of addition of silver nitrate and ammonium bromide, which is possible without renucleation occurring.

In two further trials the rates were set at 5 and 10 mls per hour. The optical micrograph of the trial at 5mls per hour clearly showed that Ostwald ripening occurred during the growth of the twinned octahedral crystals. The trial at 10 mls per hour also showed that Ostwald ripening occurred during the growth of the twinned octahedral seed crystals, but to a lesser degree. However, a trial performed at 50 mls per hour showed that ripening did not occur and thus 50 mls per hour was taken as the minimum rate of addition of silver nitrate and ammonium bromide, which is possible without Ostwald ripening occuring.

The addition rate of silver nitrate and ammonium bromide solutions for the first stage of the growth was set at 90% of the maximum addition rate possible without renucleation occuring viz. 100 mls per hour. After addition for 5.6 minutes at 100 mls per hour growth was stopped and new maximum and minimum rates were determined in a similar way. Then new maximum and minimum rates were determined at each stage in the table below. As a result the growth of the population of octahedral seed crystals was as follows:

| Stage | Duration of addition in minutes | Total time elapsed in minutes | Addition rate of 4.7M $AgNO_3$ solution (mls/hr) | Moles of AgBr present | Moles of AgBr added. | pBr |
|---|---|---|---|---|---|---|
| Coagulum prepared for | | | | | | |

-continued

| Stage | Duration of addition in minutes | Total time elapsed in minutes | Addition rate of 4.7M $AgNO_3$ solution (mls/hr) | Moles of AgBr present | Moles of AgBr added. | pBr |
|---|---|---|---|---|---|---|
| growth | 0 | 0 | 0 | 0.167 | 0 | 1.17 |
| 1 | 5.6 | 5.6 | 100 | 0.211 | 0.044 | 1.17 |
| 2 | 14.1 | 19.7 | 200 | 0.432 | 0.220 | 1.17 |
| 3 | 8.3 | 28.0 | 340 | 0.625 | 0.221 | 1.17 |
| 4 | 12.2 | 40.2 | 440 | 1.073 | 0.420 | 1.17 |
| 5 | 10.2 | 50.2 | 600 | 1.553 | 0.479 | 1.17 |
| 6 | 9.8 | 60.0 | 700 | 2.090 | 0.537 | 1.17 |

That is to say that the rate of addition was increased stepwise in a manner approximately proportional to the time from the start of the addition. This is illustrated in FIG. 1.

During the crystal growth stage no new nuclei were formed and none of the smaller crystals dissolved thus Ostwald ripening did not take place.

The final emulsion contained thin flat octahedral twinned crystals with a median linear crystal size of 1.61 $\mu$ and having a coefficient of variation of 16%.

The emulsion was (chemically sensitised) digested and tested sensitometrically. A conventional emulsion containing nearly cubic crystals of a median size of 1.65 $\mu$ was used as reference. The emulsions were coated on a base and then exposed and developed for 4 minutes in a metol/hydroquinone developer at 20° C.

These results shows the high density obtained using the emulsion made according to the present invention.

| | Silver Halide Coating Weight | Maximum Density |
|---|---|---|
| Twinned Uniform Emulsion (as just prepared) | 45.5 mg/dm$^2$ | 2.02 |
| Conventional Emulsion | 47.3 | 1.20 |

EXAMPLE 2

A population of twinned octahedral seed crystals was prepared by adding in 4 minutes to 1.21 of water containing 100g of an inert gelatin and 0.93 moles of ammonium bromide and 0.014 moles of ammonium iodide, 200 ml of 4,7M silver nitrate solution (0.94 moles) with stirring at 50° C. In this case the ripening stage occurred during the jetting-in of the silver nitrate. The seed crystals were twinned (more than 95%) and had crystals of median linear size 0.2 micron with a coefficient of variation of 32%.

The population of twinned octahedral seed crystals was adjusted to pAg 10 at 50° C. The maximum and minimum rates of addition were determined in the same way as in Example 1 and as a result the following formula for growth by adding 4.7M silver nitrate and an equivalent quantity of 4.7M ammonium bromide with stirring under pAg-controlled conditions was adopted.

| Stage | Time (minutes) | Time after start of addition | Duration of Addition | Addition Rate (ml/hr) | Volume of Silver Nitrate added (4.7M) | Total vol of Silver Nitrate present. | pBr. |
|---|---|---|---|---|---|---|---|
| 1 | 4 | 0 | 4.5 | 2700 | 200 | 400 | 1.17 |
| 2 | 8.5 | 4.5 | 5.6 | 3780 | 350 | 750 | 1.17 |
| 3 | 14.1 | 10.1 | 8.5 | 5290 | 750 | 1500 | 1.17 |
| 4 | 22.6 | 18.6 | 5.1 | 6300 | 530 | 2030 | 1.17 |
| | At this stage 600 ml of water containing 120g of gelatin were added and growth continued | | | | | | |
| 5 | 27.7 | 23.7 | 12.4 | 7490 | 1548 | 3578 | 1.17 |
| 6 | 40.1 | 36.1 | 7.0 | 9960 | 1168 | 4746 | 1.17 |

The crystals in the final emulsion then had a median crystal size of 0.80 microns with a coefficient of variation of 20%.

Figure 2:
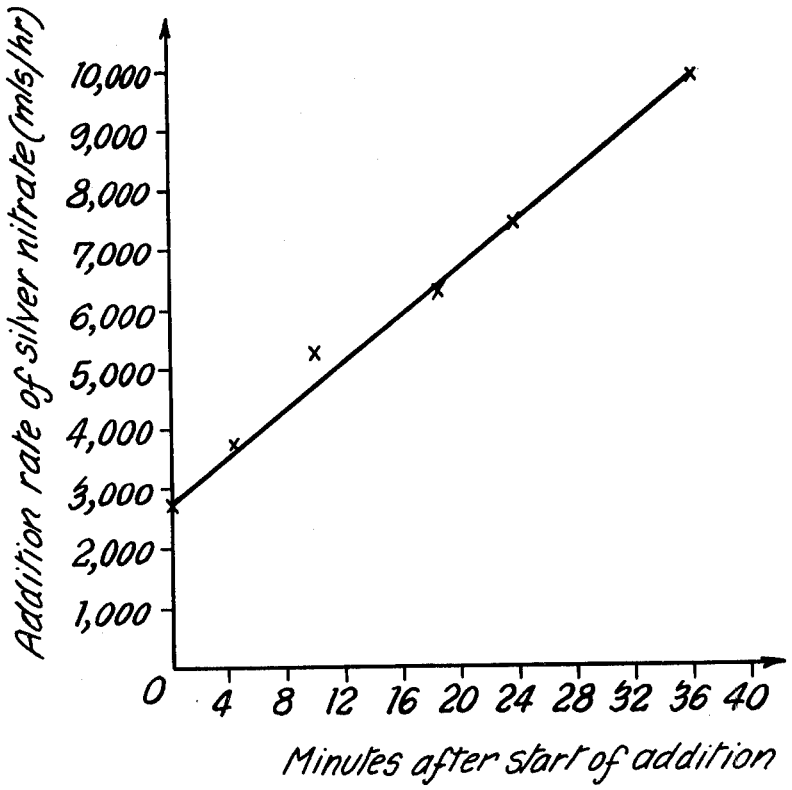

FIG. 2 shows the rates of addition plotted against the time. The rate of addition was increased stepwise in a manner approximately proportional to the time from the start of the addition. In the equation, addition rate $= b\,t + c$ (mls/hr)

$c$ has the value of 2700 mls/hr $b$ has the value of 200mls/hr/min. after addition. During the crystal growth stage, no new nuclei were formed and none of the smaller crystal dissolved; thus Ostwald ripening did not take place.

The emulsion was washed and digested conventionally. An emulsion containing cubic crystals of median size 0.82 $\mu$ was used as a reference. The emulsions were coated on a base, exposed and developed for 4 min. in a metol/hydroquinone based developer at 20° C.

| | Silver halide coating weight | Maximum density |
|---|---|---|
| Twinned uniform emulsion | 30 | 1.8 |
| Cubic emulsion | 30 | 1.5 |

I claim:

1. A method of preparing a monosize silver halide emulsion of which most of the silver halide crystals are of the twinned octahedral type which comprises a. mixing an aqueous solution of a silver salt and an aqueous solution of an alkali metal or ammonium halide in an aqueous dispersing medium containing a protective colloid at such a concentration that the silver halide is nucleated, b. causing the silver halide nuclei to increase in size in the presence of a silver halide solvent by Ostwald ripening to produce a population of twinned octahedral seed crystals, c. determining the maximum rate of addition of silver salt and alkali metal or ammonium halide which is possible without renucleation occurring and determining the minimum rate of addition of silver salt and alkali metal or ammonium halide which is possible without Ostwald ripening occurring, said determination is carried out by taking samples of the crystals, adding an equal quantity of silver halide at increasing and decreasing rates, respectively, and observing on a microscope when renucleation and Ostwald ripening, respectively, occur, d. causing the seed crystals to grow by adding to the aqueous dispersing medium aqueous silver salt solution and aqueous alkali metal or ammonium halide solution at a rate between the predetermined maximum and minimum rates and then at intervals re-determining the maximum and minimum addition rates and adjusting the addition rates of silver and halides to ensure that at all times during the crystal growth stage neither renucleation nor Ostwald ripening occurs, the p Br of the liquid phase being maintained above 0.15 during the whole crystal growth stage.

2. A method according to claim 1 wherein during crystal growth the pBr of the liquid phase is controlled between 1.00 and 1.30 and the temperature of the liquid phase is between 45° to 55° C.

3. A method according to claim 2 wherein during crystal growth the pBr of the liquid phase is controlled at 1.15 and the temperature of the liquid phase is 50° C.

4. A method according to claim 1 wherein the formation of twinned seed crystals takes place at a pAg of over 11.0 and the growth of the twinned octahedral seed crystals takes place at a pAg below 10.1.

5. A method according to claim 1 wherein the aqueous silver salt solution and the aqueous alkali metal or ammonium halide solution are added at a continuously increasing rate which is approximately proportional to the time from the start of crystal growth after seed formation, the remainder of the conditions in the dispersing medium which affect the solubility of the silver halide in solution being maintained constant.

6. A method according to claim 1 wherein the rate of addition of the silver salt and the alkali metal or ammonium halide during crystal growth is ninety percent of the maximum rate of addition which is possible without renucleation occuring.

7. A method according to claim 1 wherein the aqueous silver salt solution and the aqueous alkali-metal or ammonium halide solution are added in step-wise increased amounts, the rates of which are approximately proportional to the time from the start of crystal growth after the formation of the twinned octahedral seed crystals, the remainder of the conditions in the dispersing medium which effect the solubility of the silver halide in solution being maintained constant.

8. A monosized silver halide emulsion which has been prepared by the method claimed in claim 1.

9. Photographic material which comprises in a layer thereof at least one emulsion as claimed in claim 8.

* * * * *